US006172584B1

(12) United States Patent
Castonguay et al.

(10) Patent No.: US 6,172,584 B1
(45) Date of Patent: Jan. 9, 2001

(54) CIRCUIT BREAKER ACCESSORY RESET SYSTEM

(75) Inventors: Roger N. Castonguay, Terryville; James L. Rosen, West Hartford; Girish Hassan, Plainville, all of CT (US)

(73) Assignee: General Electric Company, Schenectady, NY (US)

( * ) Notice: Under 35 U.S.C. 154(b), the term of this patent shall be extended for 0 days.

(21) Appl. No.: 09/467,209

(22) Filed: Dec. 20, 1999

(51) Int. Cl.[7] ..... H01H 9/00

(52) U.S. Cl. ..... 335/172; 335/172

(58) Field of Search ..... 335/6, 14, 20, 335/35, 167–176

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,914 | 9/1980 | Wafer et al. . |
| 4,255,732 | 3/1981 | Wafer et al. . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

Compliant assembly (110) includes a reset drive (112) mechanically cooperating with a plunger link (120) having a slide interface latch (130) via an intermediate plunger reset spring (142), plunger link (120) also being proximate to plunger (84) to both accept strikage from or become in mechanical cooperation with plunger (84) and to reset plunger (84) from the protruded position to the retracted position. Further, in the detailed embodiment, reset drive (112) also mechanically cooperates with slide link (132) via an intermediate slide reset spring (60), slide link (132) also being proximate slide (86) to reset slide (86) from the unlatched or released position (after, for example, a trip event causes plunger (84) to protrude into contact with plunger link (120) thereby releasing slide interface latch (130) from slide latch seat (90) of slide (86)) to the latched or set position.

16 Claims, 10 Drawing Sheets

U.S. PATENT DOCUMENTS

| | | | |
|---|---|---|---|
| 4,259,651 | 3/1981 | Yamat . | |
| 4,263,492 | 4/1981 | Maier et al. . | |
| 4,276,527 | 6/1981 | Gerbert-Gaillard et al. . | |
| 4,297,663 | 10/1981 | Seymour et al. . | |
| 4,301,342 | 11/1981 | Castonguay et al. . | |
| 4,360,852 | 11/1982 | Gilmore . | |
| 4,368,444 | 1/1983 | Preuss et al. . | |
| 4,375,021 | 2/1983 | Pardini et al. . | |
| 4,375,022 | 2/1983 | Daussin et al. . | |
| 4,376,270 | 3/1983 | Staffen . | |
| 4,383,146 | 5/1983 | Bur . | |
| 4,392,036 | 7/1983 | Troebel et al. . | |
| 4,393,283 | 7/1983 | Masuda . | |
| 4,401,872 | 8/1983 | Boichot-Castagne et al. . | |
| 4,409,573 | 10/1983 | DiMarco et al. . | |
| 4,435,690 | 3/1984 | Link et al. . | |
| 4,467,297 | 8/1984 | Boichot-Castagne et al. . | |
| 4,468,645 | 8/1984 | Gerbert-Gaillard et al. . | |
| 4,470,027 | 9/1984 | Link et al. . | |
| 4,479,143 | 10/1984 | Watanabe et al. . | |
| 4,488,133 | 12/1984 | McClellan et al. . | |
| 4,492,941 | 1/1985 | Nagel . | |
| 4,541,032 | 9/1985 | Schwab . | |
| 4,546,224 | 10/1985 | Mostosi . | |
| 4,550,360 | 10/1985 | Dougherty . | |
| 4,562,419 | 12/1985 | Preuss et al. . | |
| 4,589,052 | 5/1986 | Dougherty . | |
| 4,595,812 | 6/1986 | Tamaru et al. . | |
| 4,611,187 | 9/1986 | Banfi . | |
| 4,612,430 | 9/1986 | Sloan et al. . | |
| 4,616,198 | 10/1986 | Pardini . | |
| 4,622,444 | 11/1986 | Kandatsu et al. . | |
| 4,631,625 | 12/1986 | Alexander et al. . | |
| 4,642,431 | 2/1987 | Tedesco et al. . | |
| 4,644,438 | 2/1987 | Puccinelli et al. . | |
| 4,649,247 | 3/1987 | Preuss et al. . | |
| 4,658,322 | 4/1987 | Rivera . | |
| 4,672,501 | 6/1987 | Bilac et al. . | |
| 4,675,481 | 6/1987 | Markowski et al. . | |
| 4,682,264 | 7/1987 | Demeyer . | |
| 4,689,712 | 8/1987 | Demeyer . | |
| 4,694,373 | 9/1987 | Demeyer . | |
| 4,710,845 | 12/1987 | Demeyer . | |
| 4,717,985 | 1/1988 | Demeyer . | |
| 4,733,211 | 3/1988 | Castonguay et al. . | |
| 4,733,321 | 3/1988 | Lindeperg . | |
| 4,764,650 | 8/1988 | Bur et al. . | |
| 4,768,007 | 8/1988 | Mertz et al. . | |
| 4,780,786 | 10/1988 | Weynachter et al. . | |
| 4,801,907 | * 1/1989 | Kelaita, Jr. et al. | 335/166 |
| 4,806,893 | * 2/1989 | Castonquay et al. | 335/175 |
| 4,831,221 | 5/1989 | Yu et al. . | |
| 4,870,531 | 9/1989 | Danek . | |
| 4,883,931 | 11/1989 | Batteux et al. . | |
| 4,884,047 | 11/1989 | Baginski et al. . | |
| 4,884,164 | 11/1989 | Dziura et al. . | |
| 4,900,882 | 2/1990 | Bernard et al. . | |
| 4,910,485 | 3/1990 | Bolongeat-Mobleu et al. . | |
| 4,914,541 | 4/1990 | Tripodi et al. . | |
| 4,916,420 | 4/1990 | Bartolo et al. . | |
| 4,916,421 | 4/1990 | Pardini et al. . | |
| 4,926,282 | 5/1990 | McGhie . | |
| 4,935,590 | 6/1990 | Malkin et al. . | |
| 4,937,706 | 6/1990 | Schueller et al. . | |
| 4,939,492 | 7/1990 | Raso et al. . | |
| 4,943,691 | 7/1990 | Mertz et al. . | |
| 4,943,888 | 7/1990 | Jacob et al. . | |
| 4,950,855 | 8/1990 | Bolonegeat-Mobleu et al. . | |
| 4,951,019 | 8/1990 | Gula . | |
| 4,952,897 | 8/1990 | Barnel et al. . | |
| 4,958,135 | 9/1990 | Baginski et al. . | |
| 4,965,543 | 10/1990 | Batteux . | |
| 4,983,788 | 1/1991 | Pardini . | |
| 5,001,313 | 3/1991 | Leclerq et al. . | |
| 5,004,878 | 4/1991 | Seymour et al. . | |
| 5,029,301 | 7/1991 | Nebon et al. . | |
| 5,030,804 | 7/1991 | Abri . | |
| 5,057,655 | 10/1991 | Kersusan et al. . | |
| 5,077,627 | 12/1991 | Fraisse . | |
| 5,083,081 | 1/1992 | Barrault et al. . | |
| 5,095,183 | 3/1992 | Raphard et al. . | |
| 5,103,198 | 4/1992 | Morel et al. . | |
| 5,115,371 | 5/1992 | Tripodi . | |
| 5,120,921 | 6/1992 | DiMarco et al. . | |
| 5,132,865 | 7/1992 | Mertz et al. . | |
| 5,138,121 | 8/1992 | Streich et al. . | |
| 5,140,115 | 8/1992 | Morris . | |
| 5,153,802 | 10/1992 | Mertz et al. . | |
| 5,155,315 | 10/1992 | Malkin et al. . | |
| 5,166,483 | 11/1992 | Kersusan et al. . | |
| 5,172,087 | 12/1992 | Castonguay et al. . | |
| 5,178,504 | 1/1993 | Falchi . | |
| 5,184,717 | 2/1993 | Chou et al. . | |
| 5,187,339 | 2/1993 | Lissandrin . | |
| 5,198,956 | 3/1993 | Dvorak . | |
| 5,200,724 | 4/1993 | Gula et al. . | |
| 5,210,385 | 5/1993 | Morel et al. . | |
| 5,239,150 | 8/1993 | Bolongeat-Mobleu et al. . | |
| 5,260,533 | 11/1993 | Livesey et al. . | |
| 5,262,744 | 11/1993 | Arnold et al. . | |
| 5,280,144 | 1/1994 | Bolongeat-Mobleu et al. . | |
| 5,281,776 | 1/1994 | Morel et al. . | |
| 5,296,660 | 3/1994 | Morel et al. . | |
| 5,296,664 | 3/1994 | Crookston et al. . | |
| 5,298,874 | 3/1994 | Morel et al. . | |
| 5,300,907 | 4/1994 | Nereau et al. . | |
| 5,310,971 | 5/1994 | Vial et al. . | |
| 5,313,180 | 5/1994 | Vial et al. . | |
| 5,317,471 | 5/1994 | Izoard et al. . | |
| 5,331,500 | 7/1994 | Corcoles et al. . | |
| 5,334,808 | 8/1994 | Bur et al. . | |
| 5,341,191 | 8/1994 | Crookston et al. . | |
| 5,347,096 | 9/1994 | Bolongeat-Mobleu et al. . | |
| 5,347,097 | 9/1994 | Bolongeat-Mobleu et al. . | |
| 5,350,892 | 9/1994 | Rozier . | |
| 5,357,066 | 10/1994 | Morel et al. . | |
| 5,357,068 | 10/1994 | Rozier . | |
| 5,357,394 | 10/1994 | Piney . | |
| 5,361,052 | 11/1994 | Ferullo et al. . | |
| 5,373,130 | 12/1994 | Barrault et al. . | |
| 5,379,013 | 1/1995 | Coudert . | |
| 5,424,701 | 6/1995 | Castonguary et al. . | |
| 5,438,176 | 8/1995 | Bonnardel et al. . | |
| 5,440,088 | 8/1995 | Coudert et al. . | |
| 5,449,871 | 9/1995 | Batteux et al. . | |
| 5,450,048 | 9/1995 | Leger et al. . | |
| 5,451,729 | 9/1995 | Onderka et al. . | |
| 5,457,295 | 10/1995 | Tanibe et al. . | |
| 5,467,069 | 11/1995 | Payet-Burin et al. . | |
| 5,469,121 | 11/1995 | Payet-Burin . | |
| 5,475,558 | 12/1995 | Barjonnet et al. . | |
| 5,477,016 | 12/1995 | Baginski et al. . | |
| 5,479,143 | 12/1995 | Payet-Burin . | |
| 5,483,212 | 1/1996 | Lankuttis et al. . | |
| 5,485,343 | 1/1996 | Santos et al. . | |
| 5,493,083 | 2/1996 | OIivier . | |
| 5,504,284 | 4/1996 | Lazareth et al. . | |
| 5,504,290 | 4/1996 | Baginski et al. . | |
| 5,510,761 | 4/1996 | Boder et al. . | |
| 5,512,720 | 4/1996 | Coudert et al. . | |
| 5,515,018 | 5/1996 | DiMarco et al. . | |

| | | |
|---|---|---|
| 5,519,561 | 5/1996 | Mrenna et al. . |
| 5,534,674 | 7/1996 | Steffens . |
| 5,534,832 | 7/1996 | Duchemin et al. . |
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 174 904 | 3/1996 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

LATCHED POSITION
BREAKER ON

CIRCUIT BREAKER ACCESSORY RESET SYSTEM

BACKGROUND OF THE INVENTION

This invention relates to circuit breakers, and, more particularly to a circuit breaker accessory reset system.

It is generally well known in the art of circuit breakers to provide a reset mechanism to reset a tripping device such as an accessory shunt trip or under voltage device. During quiescent operation, (i.e. when the circuit breaker contacts are closed to allow the flow of electrical current) the operating handle of an operating mechanism is in the "ON" position. To stop the current flow manually, the handle may be shifted to the "OFF" position thereby opening the electrical contacts. Upon attainment of a predetermined condition (trip event), such as ground fault or overload, the operating mechanism of the circuit breaker will release the forces of the mechanism operating springs and release the operating handle to a tripped position between the "ON" position and the "OFF" position. Before the circuit breaker may be turned "ON", the operating mechanism must be manually reset. This is accomplished by rotating the operating handle beyond the "OFF" position against the bias of the operating mechanism springs, thereby locking the operating mechanism in position.

The same mechanical forces used to direct the operating mechanism from the tripped position to the reset position are used to reset any attached accessories, such as an electronic trip actuator, a shunt trip actuator, auxiliary switch accessory, bell alarm or other type of accessory unit. However, as accessories are generally separate components mounted proximate to the operating mechanism, positional variations at the interface of the accessory and the circuit breaker operating mechanism are possible due to manufacturing tolerances. These positional variations can effect the resetting motion translated to the accessory or its components.

SUMMARY OF THE INVENTION

The present invention provides a circuit breaker accessory reset system for a circuit breaker. The circuit breaker includes a housing and a pair of contacts within the housing, the contacts being separable for interrupting a flow of an electrical current within a protected circuit upon the occurrence of a trip event. The circuit breaker accessory reset system comprises an accessory device disposed in the circuit breaker housing and a handle extending from the circuit breaker housing. The handle is provided for resetting the contacts and the accessory device after the trip event. The reset system further includes a compliant device for communicating a reset force from the handle to be accessory device, the reset force provided for resetting the accessory device.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
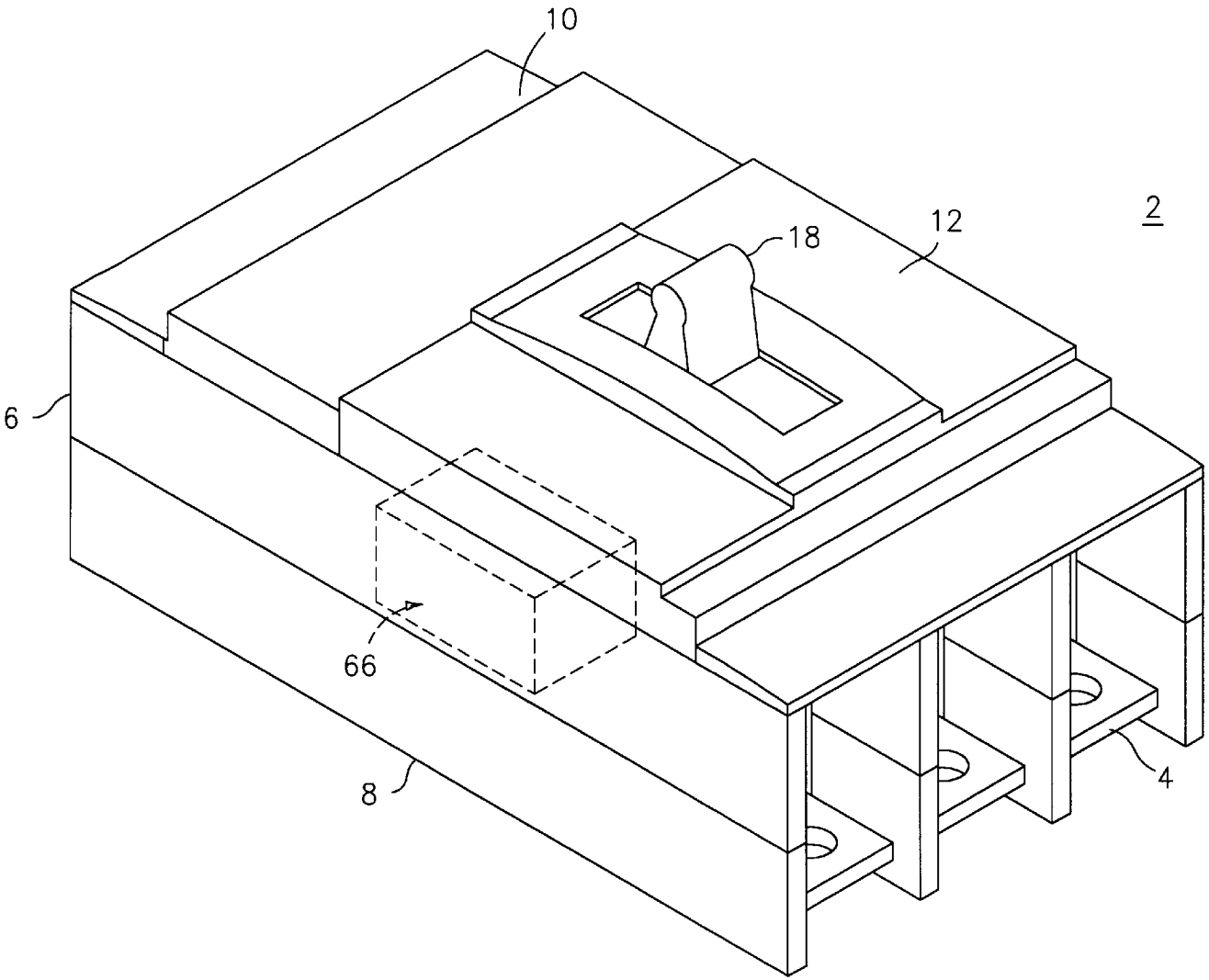
FIG. 1 is a top perspective view of a molded case circuit breaker.

A top perspective view of a circuit interrupting mechanism such as a molded case circuit breaker 2 is provided at FIG. 1 showing a general overview of the system in which an installed accessory interfacing with an operating mechanism of a circuit breaker is employed. Molded case circuit breaker 2 is generally interconnected within a protected circuit between multiple phases of a power source (not shown) at line end 4 and a load to be protected (not shown) at load end 6. Molded case circuit breaker 2 includes a base 8, a mid cover 10 and a top cover 12 having an operating handle 18 interconnected with a circuit breaker operating mechanism 14 passing therethrough. An accessory 66, such as an electronic trip actuator, a shunt trip actuator, an under voltage actuator, bell alarm or other type of accessory unit, is generally positioned within mid cover 10 as shown in phantom, and interfaces with circuit breaker operating mechanism 14.

Figure 2:
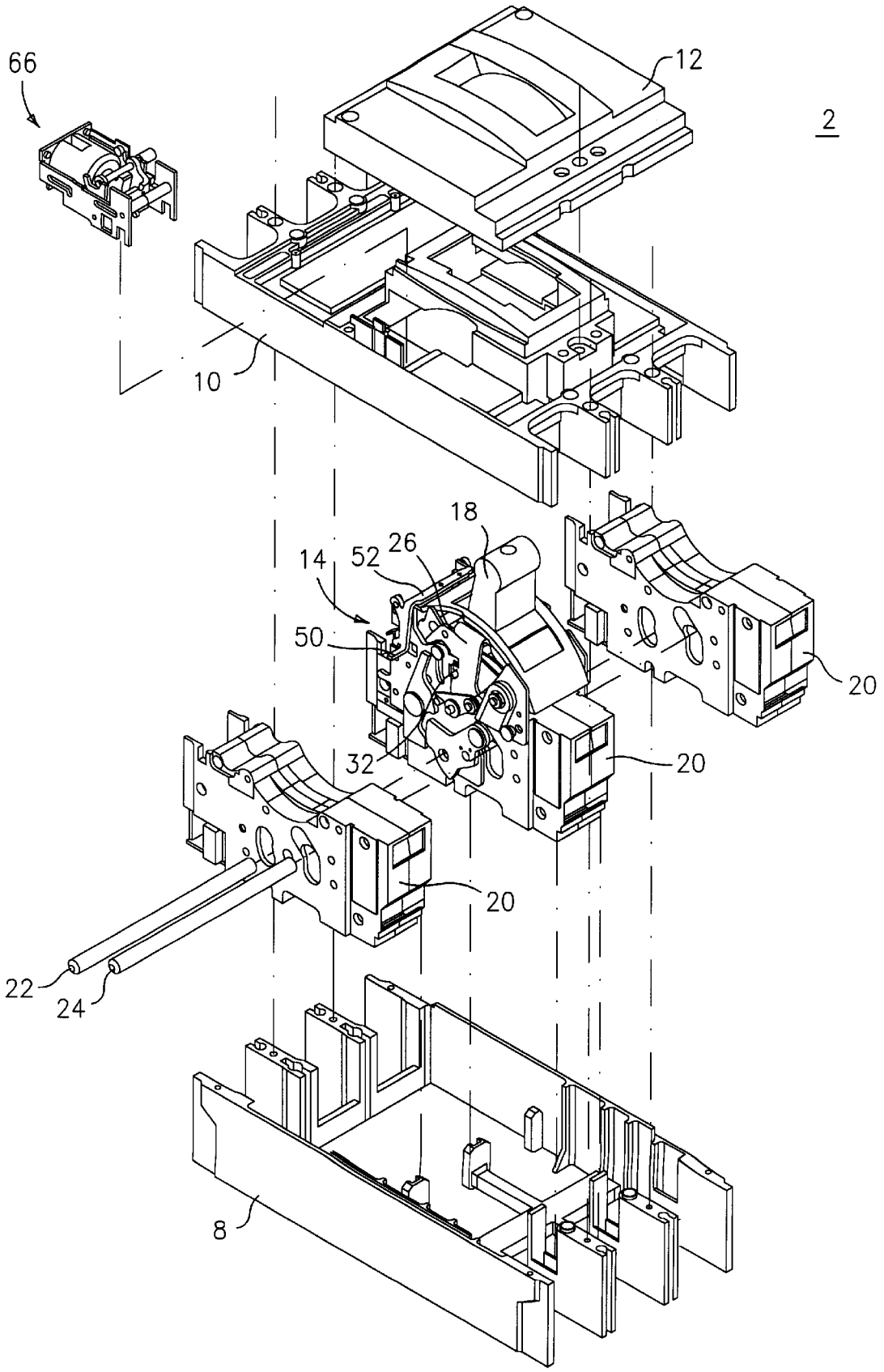
FIG. 2 is an exploded perspective view of a molded case circuit breaker.

Referring now to FIG. 2, an exploded view of molded case circuit breaker 2 is provided. A series of circuit breaker cassettes 20 are generally well known and may be, for example, of the rotary type. Circuit breaker cassettes 20 are seated approximately upstanding within base 8, and one of the cassettes 20 includes operating mechanism 14 positioned thereon. The individual phases of current are divided into three phases, wherein each phase passes through one of the circuit breaker cassettes 20. Each of cassettes 20 includes one or more contact pairs therein for passage of current when the contacts are closed and for preventing passage of current when the contact pairs are opened. It is contemplated that the number of phases, or specific type of cassette utilized, can vary according to factors including, but not limited to, the type of load circuit being protected and the type of line input being provided to the circuit breaker 2. Still referring to FIG. 2, each cassette 20 is commonly operated by a first bar 22 and a second bar 24 that interface the internal mechanisms of cassettes 20 such that when one of cassettes 20 are opened or closed, the other cassettes 20 will operate cooperatively.

Figure 3:
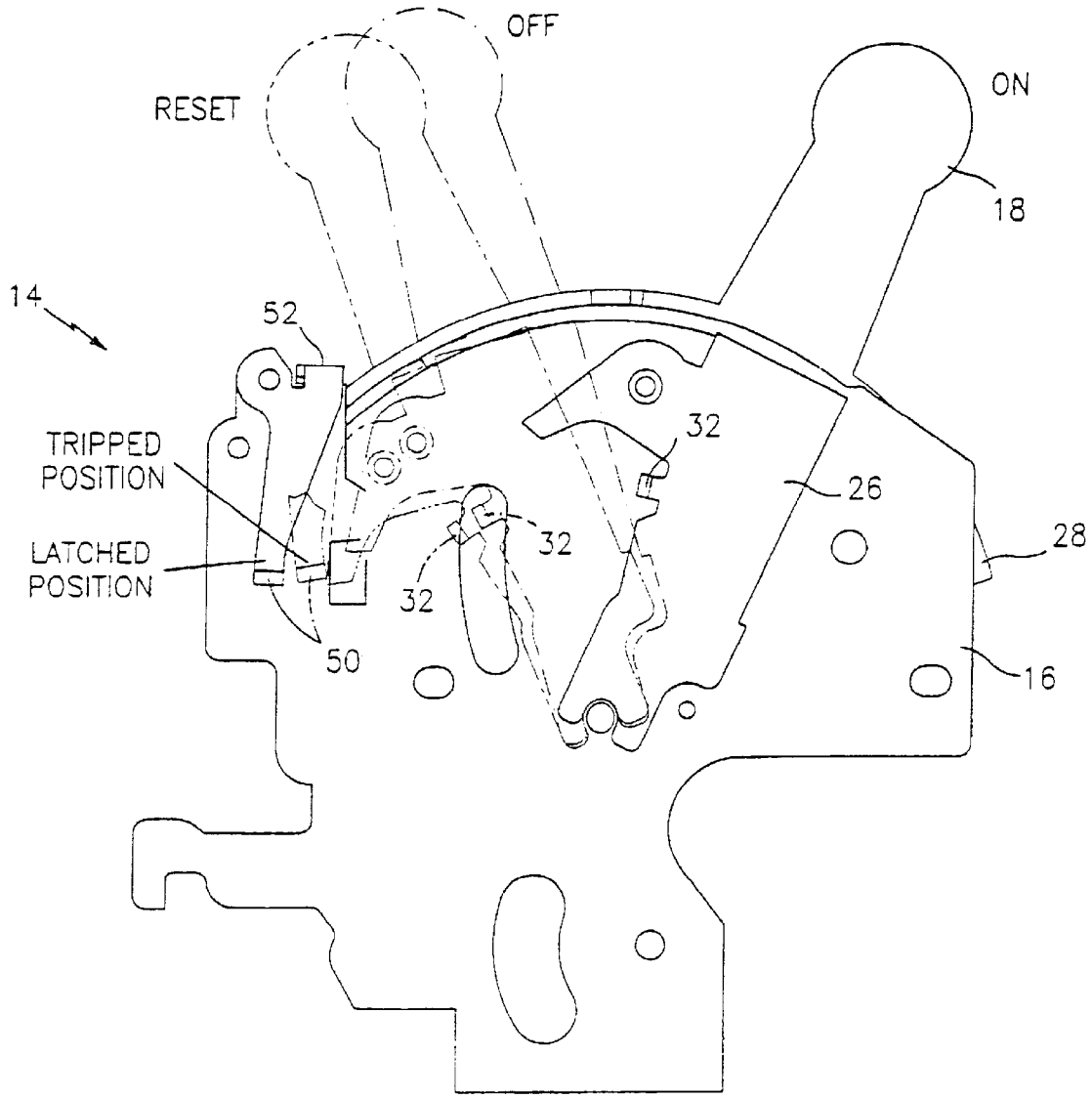
FIG. 3 is a side view depicting the general operation of a circuit breaker operating mechanism.
Figure 4:
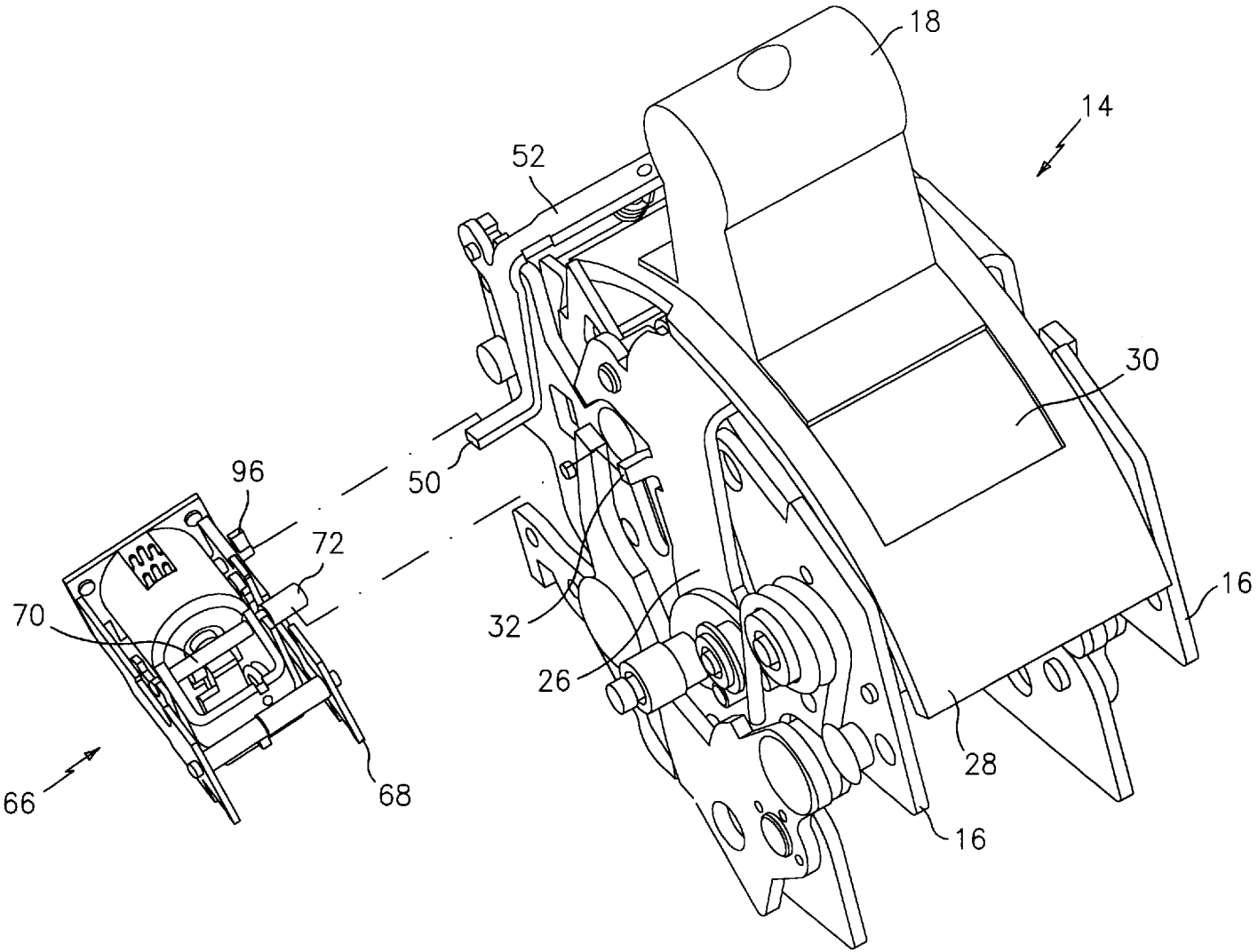
FIG. 4 is a side perspective view of an accessory and a circuit breaker mechanism.

Referring to FIGS. 2, 3 and 4 collectively, circuit breaker operating mechanism 14 includes a frame 16 having spaced apart sidewalls. An operating handle-yoke 26 generally fits over frame 16. Operating handle 18 is interconnected with operating handle-yoke 26. Operating mechanism 14 includes an operating mechanism cover 28 with a handle opening 30 formed therein allowing operating handle 18 to pass therethrough. Handle-yoke 26 includes a reset tab 32 depending generally perpendicularly therefrom to allow interface with accessory 66, and more specifically to interact with a reset pin 70 of accessory 66.

The operation of the circuit breaker operating mechanism 14 will be described generally with reference to FIG. 3, wherein the "ON" position, the "OFF" position and the "RESET" position, further counterclockwise than the "OFF" position (in phantom), are depicted. When the circuit breaker is tripped, for example by accessory 66 as described herein, in response to a trip event, operating handle 18 is between the "ON" position and the "OFF" position. Before operating handle 18 may be returned to the quiescent operation position, i.e., "ON", circuit breaker operating mechanism 14 must be reset. This is accomplished by manually rotating operating handle 18 in the counter-clockwise direction against the forces of one or more springs (not shown), thereby resetting a latch 52 of operating mechanism 14 from the "Tripped" position to the "Latched" position.

Referring now to FIGS. 3 and 4, the interface between accessory 66 and operating mechanism 14 is generally depicted. Latch 52 includes a latch trip tab 50 depending therefrom for interfacing accessory 66. Upon assembly, accessory 66 is positioned such that an actuator tab 96 is adjacent to latch trip tab 50, and a head 72 of reset pin 70 is adjacent to reset tab 32. This is generally accomplished by seating accessory 66 alongside operating mechanism 14 within mid cover 10 as shown generally in FIGS. 1 and 2.

Upon activation of accessory 66, actuator tab 96 will be displaced generally in a forward direction (toward reset pin 70) and will contact latch trip tab 50 displacing tab 50 from the "Latched" position to the "Tripped" position as shown in FIG. 3. This will release latch 52 allowing operating mechanism 14 to open a set of circuit breaker contacts (not shown) within a cassette 20.

In resetting the system, operating handle 18 is urged in the counter-clockwise direction against the bias of an operating mechanism spring (not shown) past the "OFF" position such that the appropriate latches are set as described above. The motion of operating handle 18 rotates reset tab 32, thereby driving head 72 of reset pin 70.

Figure 5:
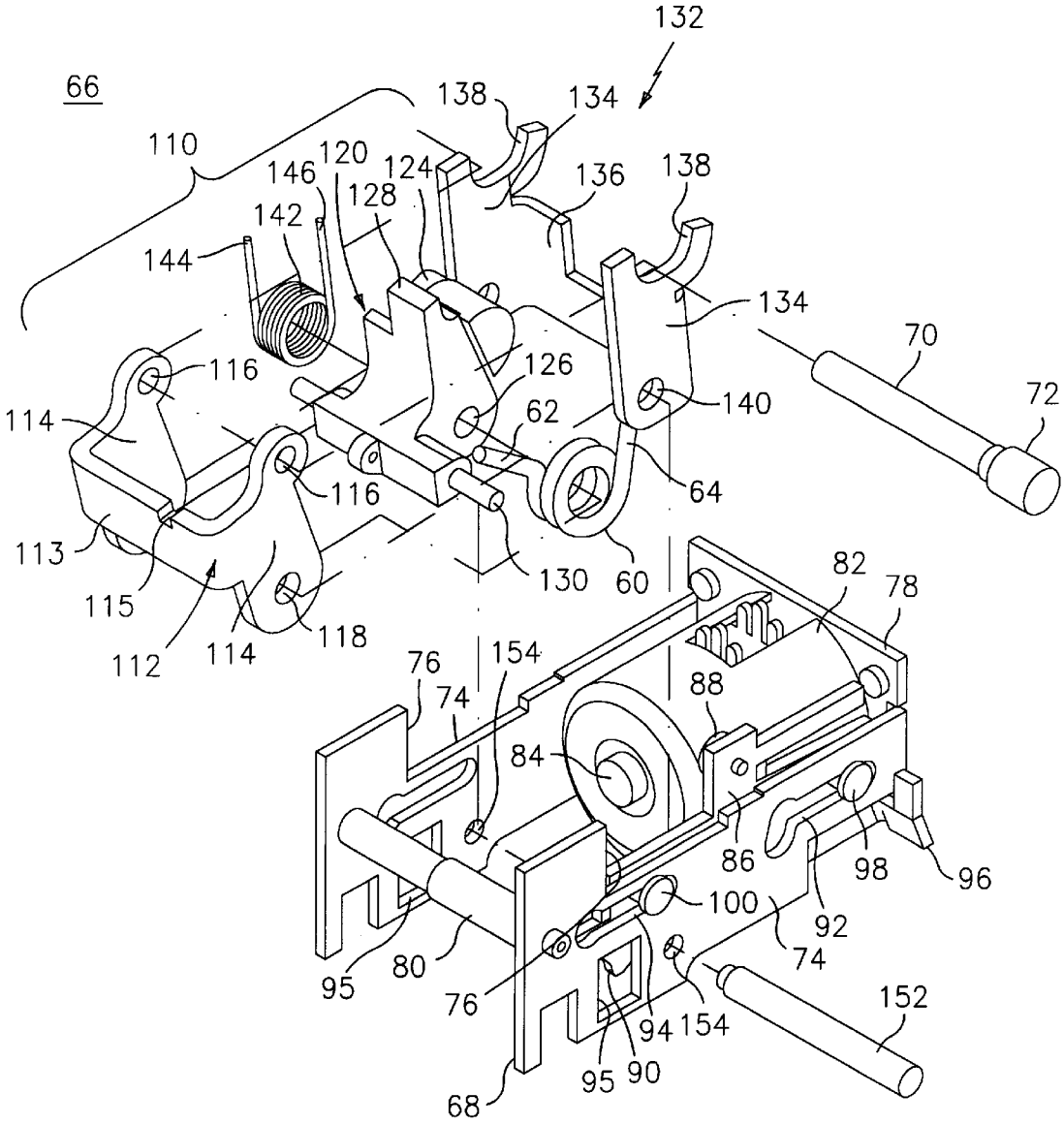
FIG. 5 is an exploded perspective view of an accessory including the features of the present invention.

The operations internal to the trip actuator will now be described in further detail with reference to the remaining Figures. Referring now to FIG. 5, an exploded side perspective view of accessory 66 including the reset system of the present invention is shown. Accessory 66 includes an accessory frame 68, an actuator 82, a slide 86 and a compliant device (compliant assembly) 110 for translating reset motion from operating handle 18. Actuator 82 may be a magnetic actuator, spring-biased actuator or other mechanical actuator that causes a plunger 84 to move from a retracted or unextended (loaded) position to a protruded or extended (tripped) position. Frame 68 includes spaced apart sidewalls 74 having stop edges 76 and frame openings 95, a back wall 78, and a crossbar 80. Slide 86 includes a slide latch seat 90 and an actuator tab 96, slide 86 being slideable within a first slot 92 and a second slot 94 by the guidance of a first slide rivet 98 and a second slide rivet 100 respectively. Compliant assembly 110 includes a reset drive 112 mechanically cooperating with a plunger link 120 via an intermediate plunger reset spring 142. Plunger link 120 includes a slide interface latch 130 and a generally semi-cylindrical cam portion 122 being proximate to plunger 84 to both accept strikage from or become in mechanical cooperation with plunger 84 and to reset plunger 84 from the protruded position to the retracted position. Further, in the detailed embodiment, reset drive 112 also mechanically cooperates with a slide link 132 via an intermediate slide reset spring 60. Slide link 132 is proximate slide 86 to reset slide 86 from the unlatched or released position (after, for example, a trip event causes plunger 84 to protrude into contact with plunger link 120 thereby releasing slide interface latch 130 from slide latch seat 90 of slide 86) to the latched or set position.

It will be understood by those skilled in the art that either or both reset systems employing the spring interfaces (i.e., the interface at plunger reset spring 142 between reset drive 112 and plunger link 120 and the interface at slide reset spring 60 between reset drive 112 and slide link 132) may be provided within compliant assembly 110. Therefore, accessories may include, for example, a different plunger reset mechanism and slide reset spring 60 as described herein, a different slide reset mechanism and plunger reset spring 142 as described herein, or both slide reset spring 60 and plunger reset 142 as described herein. The spring interfaces are employed to provide mechanical cooperation between the interfaced members while adding compliancy to absorb forces in excess of those required to reset the component. Furthermore, while slide reset spring 60 and plunger reset spring 142 are depicted as torsional springs, any compliant member may be employed, such as torsional springs, compression springs, or leaf springs.

The aspects of the depicted compliant assembly 110 will now be described in more detail. Reset drive 112 has a central drive member 113 between and perpendicular to generally parallel spaced apart side drive members 114. Slide link 132 has a central link member 136 between and perpendicular to generally parallel spaced apart side link members 134. Side drive members 114 have drive pivot apertures 118 thereon and side link members 134 have complementary link pivot apertures 140 thereon to allow passage of a pivot pin 152. Side drive members 114 of reset drive 112 further include a reset pin aperture 116 at the top thereof to allow passage of reset pin 70. Additionally, side link members 134 of slide link 132 have a reset hook portion 138 at the top thereof to seat reset pin 70. Slide 86 includes a slide pin 88 is contacted by the outer edge of hook portion 138 upon clockwise rotation of slide link 132, as in to reset slide 86. Plunger link 120 includes an upstanding portion 128 that is in contact with reset pin 70 upon counter-clockwise movement. Pivot pin 152 is positioned between corresponding frame pivot apertures 154 upon sidewalls 74 of frame 68 such that the operation of slide 86 is not affected. Pivot pin 152 is a common pivot point for slide link 132 about link pivot apertures 140 upon side link members 134, reset drive 112, about drive pivot apertures 118 upon side drive members 114, plunger link 120, about a pivot bore 126 therethrough, plunger reset spring 142, and slide reset spring 60. Slide reset spring 60 includes a first end 62 compliantly maintained by central drive member 113 of reset drive 112 generally guided by a spring end notch 115, and a second end 64 of slide reset spring 60 compliantly maintained against central link member 136 of slide link 132. When reset drive 112 is rotated in the clockwise direction, as to reset the accessory after a trip (described further herein), slide link 132 will accordingly rotate in the clockwise direction. Plunger reset spring 142 likewise has a first end 144 compliantly maintained by central drive member 113 of reset drive 112, and further has a second end 146 compliantly maintained by a spring end extension 124 of plunger link 120. The clockwise rotation of reset drive 112 as to reset the accessory after a trip (described further herein) will accordingly transmit motion simultaneously through: a) slide reset spring 60 to slide link 132 thereby urging slide 86 to the latched position via hook portion 138 driving slide pin 88, and b) plunger reset spring 142 to plunger link 120 thereby urging plunger 84 in the retracted or loaded position.

Figure 6:
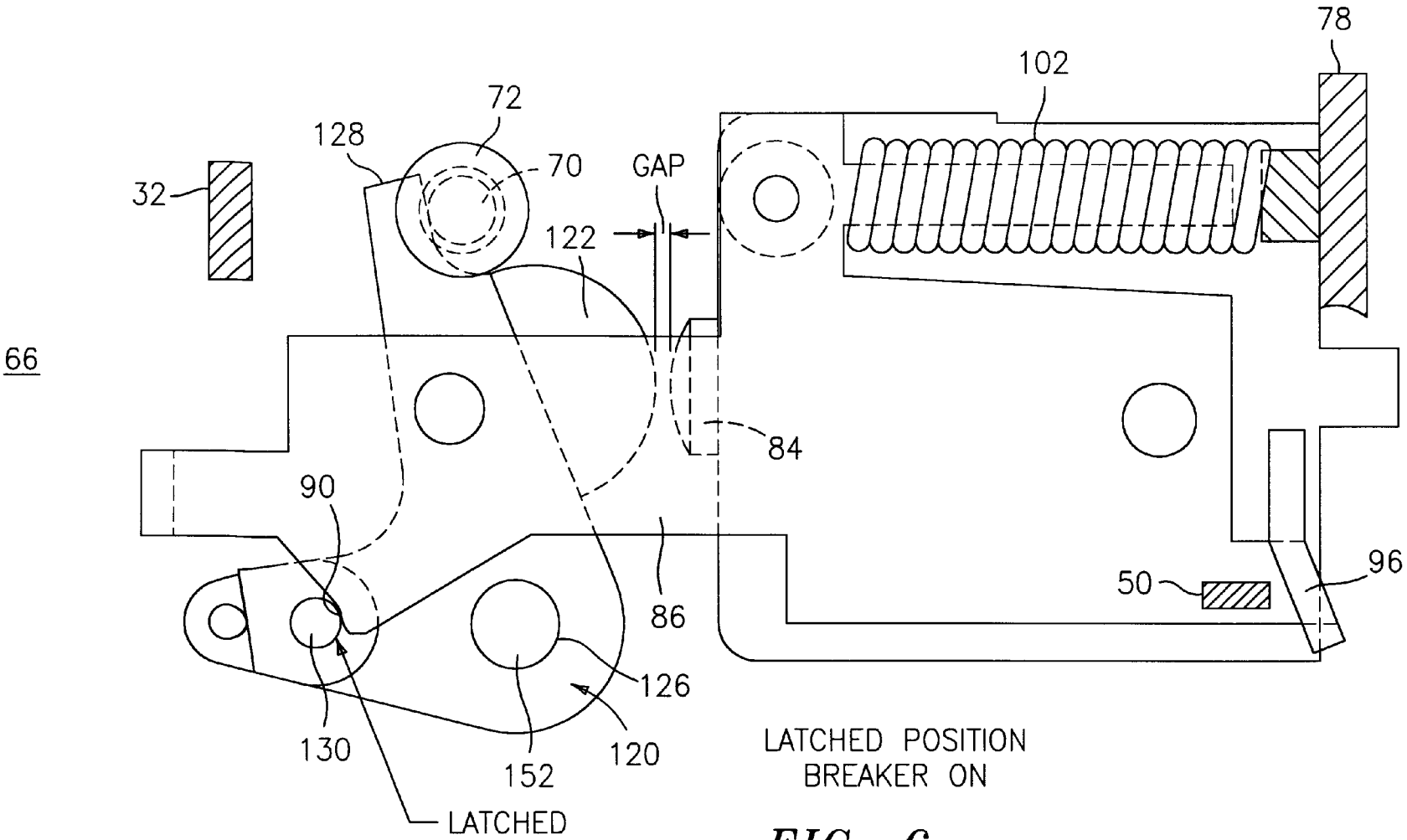
FIG. 6 is a side view of the accessory of FIG. 5 in the latched position.

With reference to FIGS. 5–8, various conditions of the circuit breaker and accessory 66 will now be described. When the breaker is "ON", the actuator/accessory unit is latched such that slide interface latch 130 holds slide 86 at slide latch seat 90 against the forces of a compression spring 102, as depicted in FIG. 6, wherein a side view of the latched condition of accessory 66 is provided. This is the condition of quiescent operation of the circuit breaker, wherein both slide interface latch 130 is engaged with slide latch seat 90 and plunger 84 is loaded or retracted within actuator 82. In this position, there is a space between trip actuator tab 96 and latch trip tab 50 of operating mechanism 14 (see FIG. 4), and additionally there is a gap between plunger 84 and cam portion 122 extending from plunger link 120. Reset tab 32 of operating mechanism 14 (FIG. 2) is also depicted as not having contact with reset pin 70.

Figure 7:
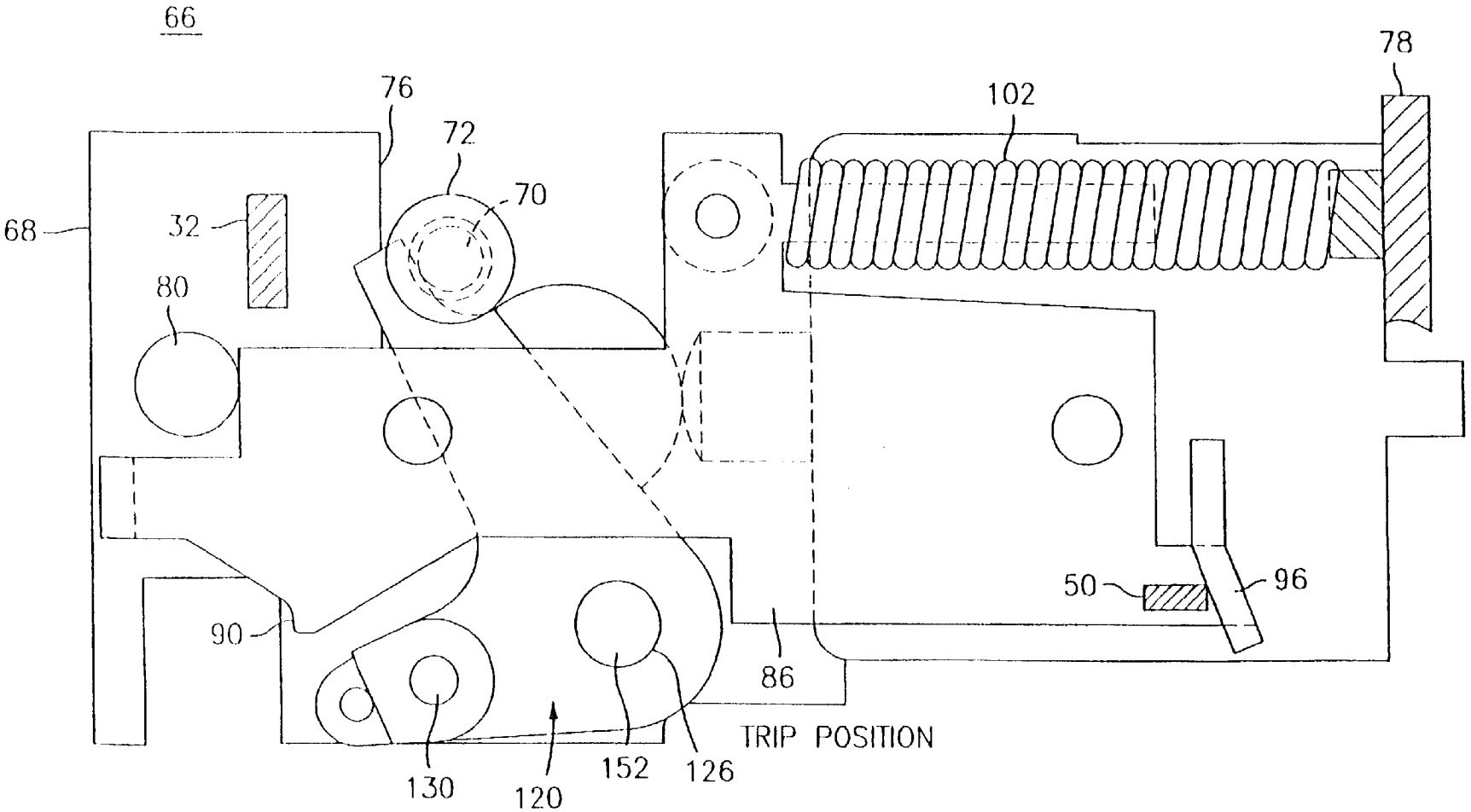
FIG. 7 is a side view of the accessory of FIG. 5 in the tripped state.

When an electronic pulse is provided (for example, remotely via a manual control or electronic trip unit, not shown) to actuator 82, plunger 84 protrudes and contacts cam portion 122 of plunger link 120. This causes plunger link 120 having slide interface latch 130 to pivot in the counter-clockwise direction about pivot pin 152 thereby releasing slide interface latch 130 from trip slide latch 90. In certain embodiments, slide interface latch 130 protrudes a distance beyond trip slide latch 90, wherein a frame opening 95 is provided. Frame opening 95 doubly serves to block slide interface latch 130 depending from plunger link 120 from counter-clockwise rotation past the inside edge of frame opening 95. The release of slide 86 causes compression spring 102 to extend to its shaped state until slide 86 is blocked by crossbar 80, as seen in FIG. 7, wherein a side view of accessory 66 in the tripped position is provided. Slide interface latch 130 is released from slide latch seat 90 in the tripped position, and actuator tab 96, integral with and extending perpendicularly from slide 86, is displaced to the left as shown in FIG. 7 against latch trip tab 50 causing the operating mechanism 14 to trip as described above with reference to FIG. 4. As can be seen by referring to FIGS. 5 and 7, since plunger link 120 cooperates with reset drive 112 via plunger reset spring 142 and reset drive 112 cooperates with slide link 132 via slide reset spring 60, both reset drive 112 and slide link 132 are urged counter-clockwise. In turn, reset pin 70 is translated in the counter-clockwise direction relative to pivot pin 152 since reset pin 70 travels correspondingly with slide link 132. Reset pin 70 travels in the counter-clockwise direction to the point where further movement is prevented due to the contact of reset pin head 72 with stop edge 76 of frame 68. This blockage prevents the entire compliant assembly 110 from collapsing by continued counter-clockwise rotation.

Figure 8:
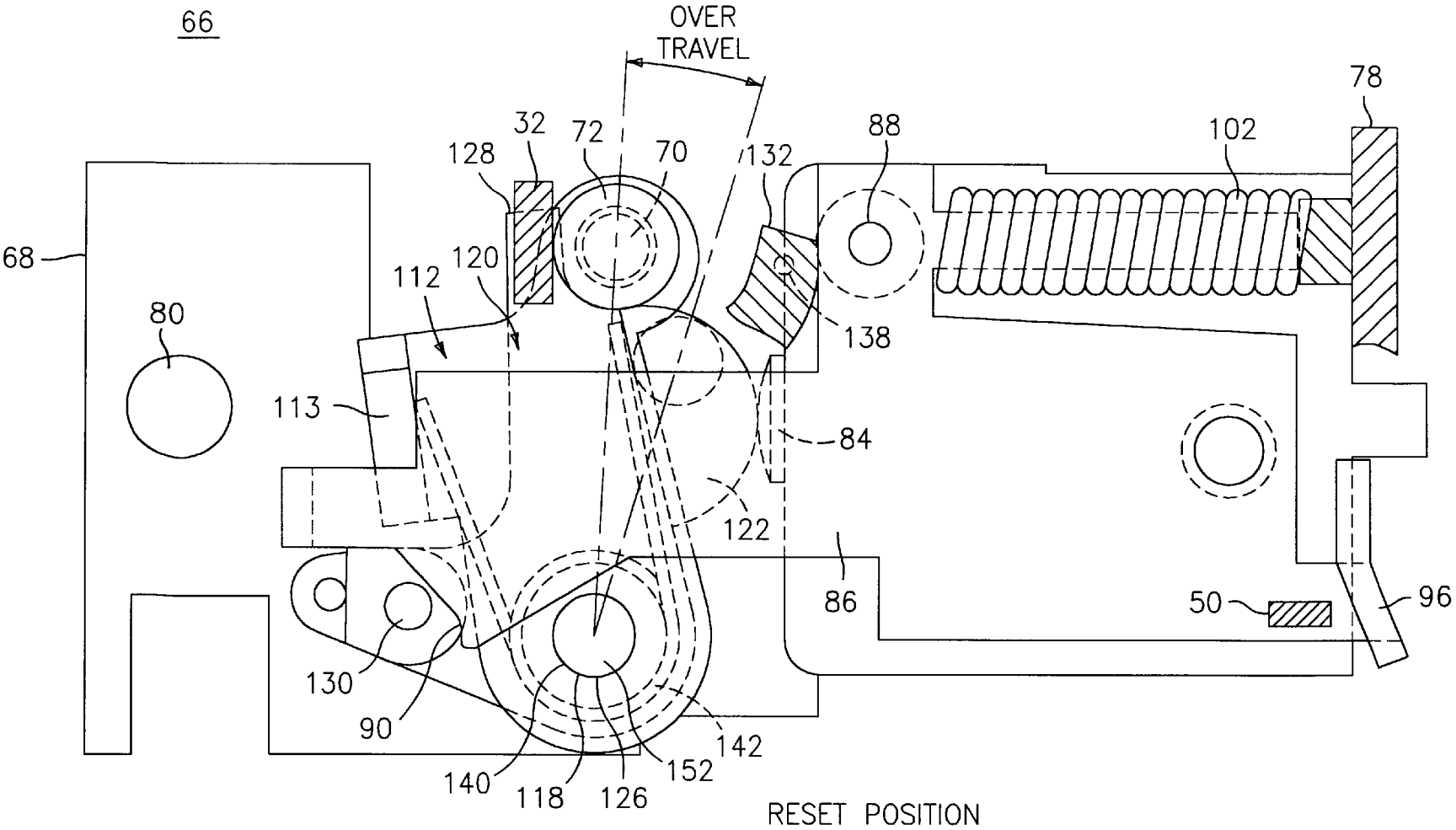
FIG. 8 is a side view of the accessory of FIG. 5 during resetting.

In order to reengage the operating mechanism to the "ON" position, so as to return to quiescent condition, both operating mechanism 14 and accessory 66 must be reset. This condition, with respect to accessory 66, is depicted in FIG. 8, wherein a side view accessory 66 in the "RESET" position is provided. Reset tab 32, integral with operating handle-yoke 26 (FIG. 2), is manually urged in the clockwise direction against head 72 of reset pin 70 thereby creating a reset motion that rotates reset drive 112 in the clockwise direction. Semi-cylindrical cam portion 122 protruding from plunger link 120 pushes plunger 84 back into its retracted loaded position suitable for quiescent operation to the point where it is held in place (for example, via magnetic forces in a magnetic actuator or via an interference latch in a mechanical or spring actuator). The slide is latched (therefore reset) when slide interface latch 130 engages slide latch seat 90 and compression spring 102 becomes charged, and hook portion 138 of slide link 132 is prevented from further clockwise rotation by slide pin 88. If further clockwise motion is applied upon reset pin 70, plunger reset spring 142 will continue to absorb the forces and provide added degrees of clockwise over travel to reset pin 70 and reset drive 112, while cam portion 122 of plunger link 120 does not force plunger 84 any further into actuator 82.

Additionally, in the embodiment detailed, an over travel system is further provided by slide reset spring 60 interposed between reset drive 112 and slide link 132. When additional reset force is applied after slide interface latch 130 is engaged with trip slide latch 90, slide 86 will not be forced against back wall 78. Rather, slide reset spring 60 will absorb the forces, thereby allowing for a compact accessory including a back wall 78.

Figure 9:
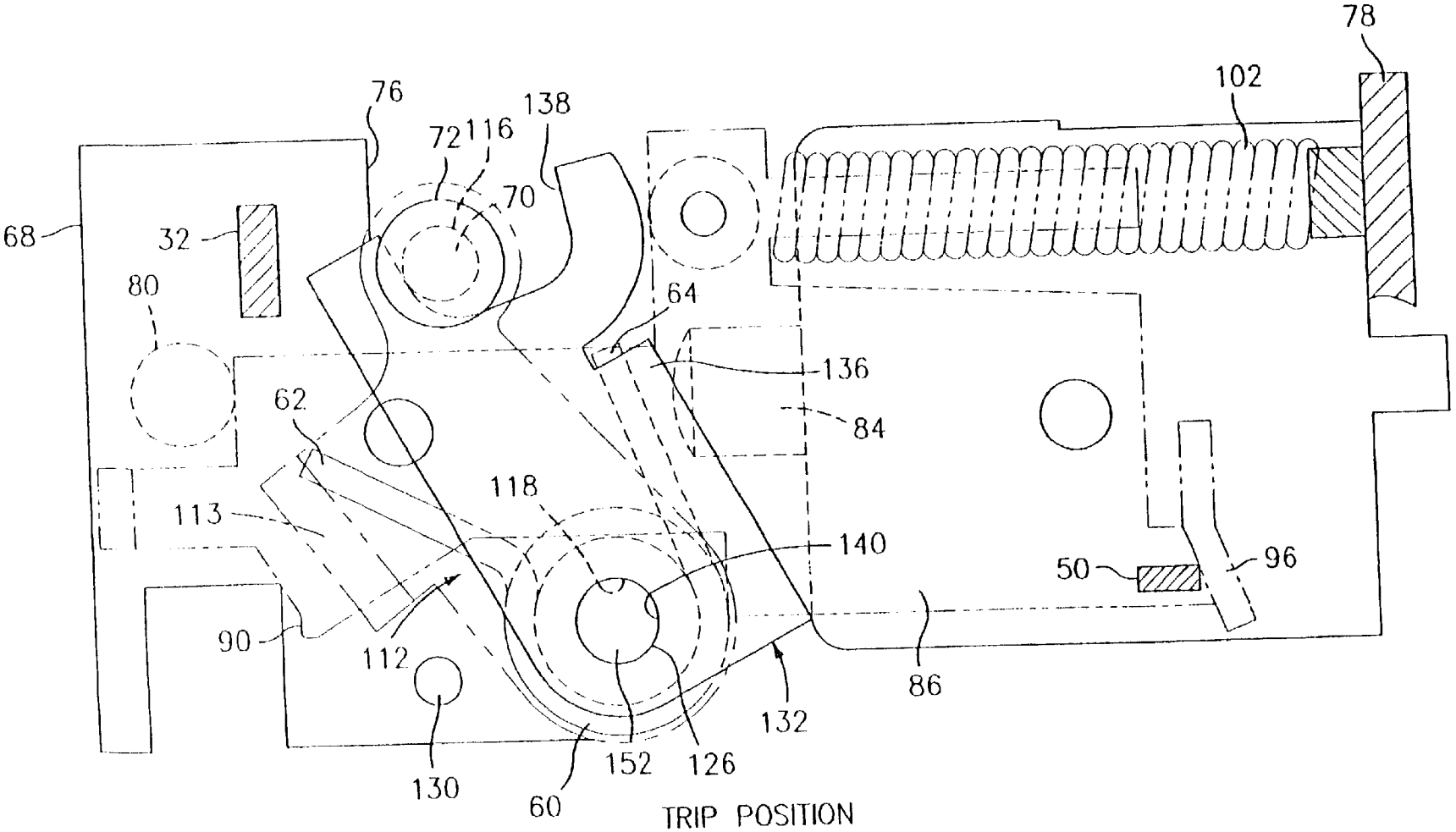
FIG. 9 is a side view of the accessory of FIG. 5 in a tripped condition.
Figure 10:
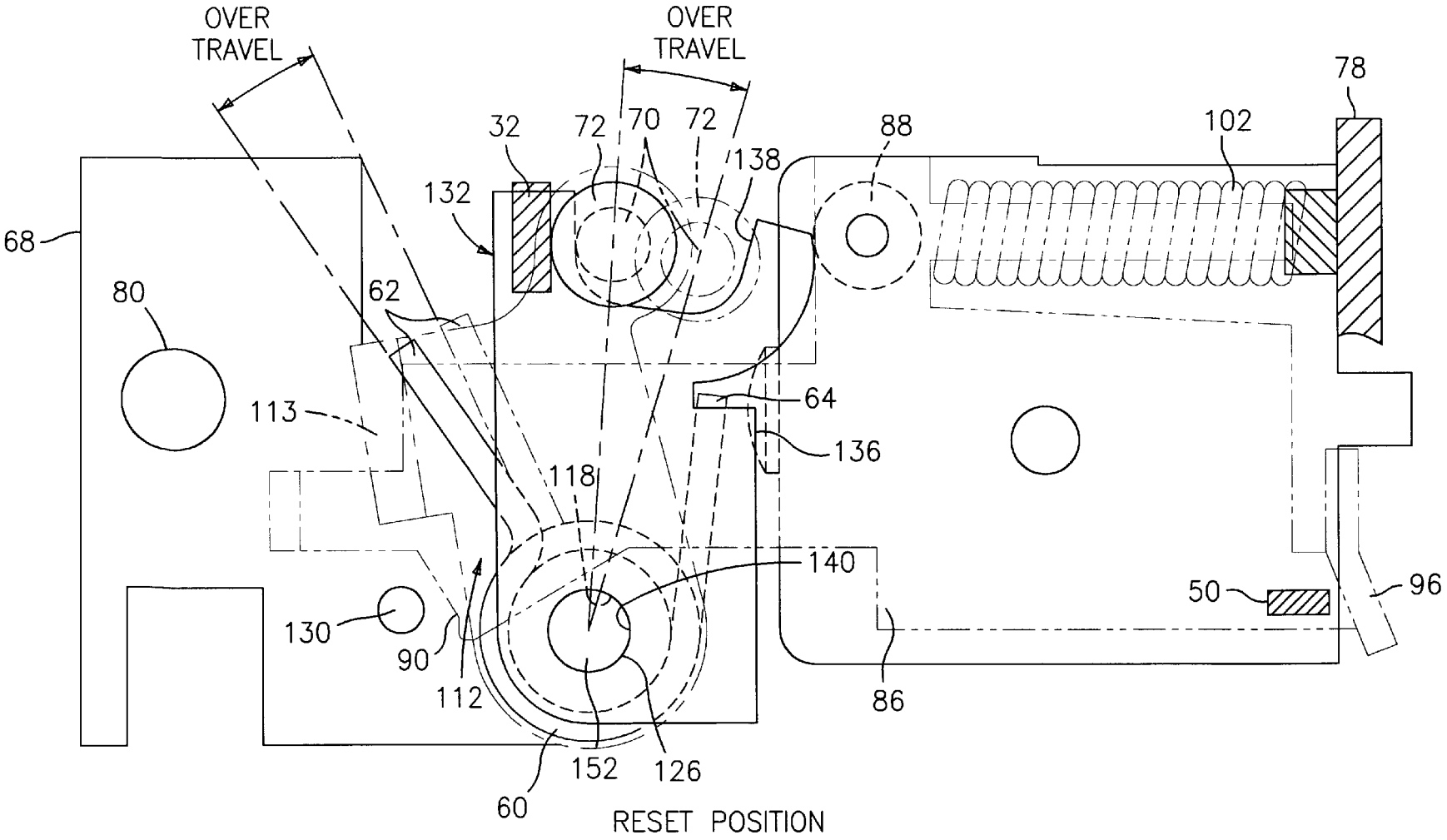
FIG. 10 is a side view of the accessory of FIG. 5 during resetting.

The relative positions of first end 62 and second end 64 of slide reset spring 60 are apparent in FIG. 9, where a side view of the accessory in a tripped condition is provided, and FIG. 10, where a side view of the accessory during resetting is provided.

Referring to FIG. 9, the first end 62 of slide reset spring 60 is in contact with central drive member 113 of reset drive 112 and the second end 64 of slide reset spring 60 is in contact with central link member 136 of slide link 132. As described previously, plunger 84 displaces plunger reset link 120 in the counterclockwise direction which causes slide interface latch 130 to become unlatched in relation to trip slide latch 90, and slide 86 becomes displaced and in contact with crossbar 80. The counter-clockwise rotation of plunger link 120 causes both reset drive 112 and slide link 132 to rotate counter-clockwise since plunger link 120 cooperates with reset drive 112 via plunger reset spring 142 (shown in FIG. 8) and reset drive 112 cooperates with slide link 132 via slide reset spring 60. Reset pin 70 is translated in the counter-clockwise direction relative to pivot pin 152 to the point where further movement of reset pin 70 is prevented due to reset pin head 72 being blocked by stop edge 76. Consequently, hook portion 138 of slide link 132 does not continue counter-clockwise rotation as it is carried in the counter-clockwise direction by reset pin 70. Slide link 132 is dually prevented from counter-clockwise rotation, first, due to the position of reset pin 70 between reset pin apertures 116 of reset drive 112 and the synchronous relation between reset drive 112 and slide link 132, and second, due to the force by reset pin 70 upon the inside edge of hook portion 138.

Referring now to FIG. 10, where the accessory is being reset, the features of slide reset spring 60 will be described in further detail. Note that the reset operation as described heretofore, especially with respect to FIG. 8, is complemented by slide reset spring 60. Following the clockwise force applied to reset drive 112 from the force of reset tab 32 driving reset pin head 72, slide reset spring 60 is rotated clockwise. As described previously, slide interface latch 130 of plunger link 120 catches slide latch seat 90 and compression spring 102 becomes charged. Slide 86 will bottom out upon contact with back wall 78. Clockwise force applied to reset drive 112 may be maintained first to the point where the outside edge of hook portion 138 of slide link 132 contacts slide pin 88. Thereafter, additional clockwise force will allow reset pin 70 to continue to travel in the clockwise direction (shown in phantom) and allow for additional degrees of over travel until reset pill 70 contacts the inside edge of hook portion 138 (nearest to slide pin 88), and continuing force will be absorbed by slide reset spring 60. Thus, a compact accessory may be provided, since the contact of slide 86 with back wall 78 would be undesirable without an over travel system to take up the extra force. Additionally, any manufacturing variances as to the precise location of accessory 66 within mid-cover 10 and relative to reset tab 32 of operating mechanism 14 are tolerated, as are field or installation imperfections that may jolt or otherwise shift the locations of accessory 66 relative to reset tab 32.

While the invention has been described with reference to a preferred embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker accessory reset system for a circuit breaker, the circuit breaker including a housing and a pair of contacts within the housing, contacts being separable for interrupting a flow of electrical current in a protected circuit upon the occurrence of a trip event, the circuit breaker accessory reset system comprising:

an accessory device disposed in the circuit breaker housing including a plunger configured for movement between a retracted position and a protruded position;

a handle extending from the circuit breaker housing, the handle for resetting the contacts and the accessory device after the trip event; and a compliant device including a plunger link configured for mechanical cooperation with the plunger in the protruded position, a reset drive configured for mechanical cooperation with the handle, and a compliant member positioned and configured for mechanical cooperation with the reset drive and the plunger link, a force being applied from the handle to the accessory device, the force for resetting the accessory device by being transmitted from the handle to the reset drive, from the reset drive to the compliant member, from the compliant member to the plunger link, and from the plunger link to the plunger for resetting the plunger from the protruded position to the retracted position.

2. The circuit breaker accessory reset system as in claim 1, wherein the compliant member is a member selected from the group consisting of torsional springs, leaf springs, compression springs, a plurality of any of the foregoing members, and any combination of the foregoing members.

3. The circuit breaker accessory reset system as in claim 1, wherein the reset drive and the plunger link rotate about a common pivot.

4. A circuit breaker accessory reset system for a circuit breaker, the circuit breaker including a housing and a pair of contacts within the housing, contacts being separable for interrupting a flow of electrical current in a protected circuit upon the occurrence of a trip event by, including being separable by action of an operating mechanism, the circuit breaker accessory reset system comprising:

an accessory device disposed in the circuit breaker housing including a slide configured for being latched within the accessory device in a latched position and for being releasable by a spring bias in a released, unlatched position, wherein the released unlatched position contacts a portion of the operating mechanism causing separation of the contacts;

a handle extending from the circuit breaker housing, the handle for resetting the contacts and the accessory device after the trip event; and a compliant device including a slide link configured for mechanical cooperation with the slide in the released, unlatched position, a reset drive configured for mechanical cooperation with the handle, and a first compliant member positioned and configured for mechanical cooperation with the reset drive and the slide link.

a force being applied from the handle to the accessory device, the force for resetting the accessory device by being transmitted from the handle to the reset drive, from the reset drive to the first compliant member, from the first compliant member to the slide link, and from the slide link to the slide for resetting the slide from the released, unlatched position to the latched position.

5. The circuit breaker accessory reset system as in claim 4, wherein the first compliant member is a member selected from the group consisting of torsional springs, leaf springs, compression springs, a plurality of any of the foregoing members, and any combination of the foregoing members.

6. The circuit breaker accessory reset system as in claim 4, wherein the reset drive and the slide link rotate about a common pivot.

7. The circuit breaker accessory reset system as in claim 4, the accessory device further including a plunger configured for movement between a retracted position and a protruded position, wherein the compliant device further includes a plunger link configured for mechanical cooperation with the plunger in the protruded position and a second compliant member positioned and configured for mechanical cooperation with the reset drive and the plunger link.

8. The circuit breaker accessory reset system as in claim 7, wherein the second compliant member is a member selected from the group consisting of torsional springs, leaf springs, compression springs, a plurality of any of the foregoing members, and any combination of the foregoing members.

9. The circuit breaker accessory reset system as in claim 7, wherein the reset drive, the plunger link and the slide link rotate about a common pivot.

10. An accessory for interfacing with a circuit interrupting mechanism having a trip latch and a reset tab, the accessory comprising:

a. a slide member being configured, dimensioned and positioned to provide motion between a latched position and a tripped position by a compression spring, the movement from the latched position to the tripped position applying a force to the trip latch;

b. an actuator having a plunger, the plunger being configured, dimensioned and positioned for movement between a unextended position and an extended position, and c. a link assembly being configured, dimensioned and positioned for i. maintaining the slide member in the latched position, ii. receiving a strike from the plunger when the plunger moves from the unextended position to the extended position, the strike causing the link assembly to release the slide member from the latched position to be tripped position, and iii. mechanically cooperating with the reset tab when a reset force is provided and translating the reset force to the plunger in the extended position to return the plunger to the retracted position, and further translating the reset force to the slide member in the tripped position to return the slide member to the latched position.

11. The accessory as in claim 10, wherein the link assembly includes:

a compliant member intermediate to the reset tab and the plunger, the compliant member absorbing reset force applied after the plunger is returned to the retracted position.

12. The accessory as in claim 11, wherein the compliant member is a member selected from the group consisting of torsional springs, leaf springs, compression springs, a plurality of any of the foregoing members, and any combination of the foregoing members.

13. The accessory as in claim 10, wherein the link assembly includes:

a compliant member intermediate to the reset tab and the slide member, the compliant member absorbing reset force applied after the slide member is returned to the latched position.

14. The accessory as in claim 13, wherein the compliant member is a member selected from the group consisting of torsional springs, leaf springs, compression springs, a plurality of any of the foregoing members, and any combination of the foregoing members.

15. The accessory as in claim 10, wherein the link assembly includes:

a first compliant member intermediate to the reset tab and the plunger; and a second compliant member intermediate to the reset tab and the slide member, the first compliant member absorbing reset force applied after the plunger is returned to the retracted position and the second compliant member absorbing reset force applied after the slide member is returned to the latched position.

16. The accessory as in claim 15, wherein the first compliant member is a first member selected from the group consisting of torsional springs, leaf springs, compression springs, a plurality of any of the foregoing first members, and any combination of the foregoing members, and the second compliant member is a second member selected from the group consisting of torsional springs, leaf springs, compression springs, a plurality of any of the foregoing second members, and any combination of the foregoing members.

* * * * *

UNITED STATES PATENT AND TRADEMARK OFFICE

CERTIFICATE OF CORRECTION

PATENT NO. : 6,172,584 B1
DATED : January 9, 2001
INVENTOR(S) : Castonguay et al.

It is certified that error appears in the above-identified patent and that said Letters Patent is hereby corrected as shown below:

Column 1,
Line 52, after "to" delete "be" and insert therefor -- the --

Column 2,
Line 23, after "20" (first occurrence) delete "are" and insert therefor -- is --

Column 4,
Line 33, after "88" and insert therefor -- which --

Column 5,
Line 19, after "from" delete "trip slide latch" and insert therefor -- slide latch seat --
Line 21, after "beyond" delete "trip slide latch" and insert therefor -- slide latch seat --

Column 8,
Line 49, after "between" delete "a" and insert therefor -- an --

Signed and Sealed this

Second Day of November, 2004

JON W. DUDAS
*Director of the United States Patent and Trademark Office*